United States Patent [19]

Sobel

[11] 3,978,851

[45] Sept. 7, 1976

[54] MASSAGING APPARATUS

[76] Inventor: P. Brav Sobel, 3140 N. Bay Road, Miami Beach, Fla. 33140

[22] Filed: Mar. 31, 1975

[21] Appl. No.: 563,572

Related U.S. Application Data

[62] Division of Ser. No. 348,128, April 5, 1973, Pat. No. 3,874,373.

[52] U.S. Cl. ..... 128/49; 128/56; 128/79

[51] Int. Cl.[2] ..... A61H 7/00

[58] Field of Search ..... 128/32, 44–52, 128/59, 56, 79, 61, 24.2

[56] References Cited

UNITED STATES PATENTS

| | | | |
|---|---|---|---|
| 2,863,445 | 12/1958 | Johnson | 128/24.2 |
| 3,030,950 | 4/1962 | Forthun | 128/44 |
| 3,362,401 | 1/1968 | Katz | 128/44 |
| 3,626,931 | 12/1971 | Bysakh | 128/32 |
| 3,799,155 | 3/1974 | Gerlich | 128/44 |

*Primary Examiner*—Lawrence W. Trapp
*Attorney, Agent, or Firm*—Griffin, Branigan and Butler

[57] ABSTRACT

A body massaging apparatus is described herein which includes a plurality of separate stroking devices and a remote power-pack device for energizing and controlling the stroking devices. All of the stroking devices comprise variable speed electric motors for moving stroking tools at gradually adjustable speeds.

A rotating-type stroking-device comprises a universal attaching member which is capable of being attached directly to various types of limp, flexible, stroking materials for rotating them. In one embodiment the universal attaching member is a clamp.

A clasping-type stroking device comprises a housing with an elongated jaw member pivotally attached to the housing. The variable speed motor is used to pivot the elongated jaw member toward and away from a jaw portion of the housing. Both the jaw member and the jaw portion are constructed with soft outer coverings thereon.

A gripping-type stroking device comprises a housing with two gripping members, each having at least two gripping arms, extending outwardly from the housing. The variable speed motor drives the gripping members to pivot back-and-forth, about pivot points on the housing, thereby causing the gripping members to have backward and forward stroking motions. In one embodiment the two gripping members are moving in phase and in another embodiment their motion is 180° out of phase.

A rotational/swinging stroking device comprises a cylindrical helical-spring stroking tool which can be both rotated along a longitudinal axis or pivoted in a swinging motion.

Also disclosed is a stand which can be used to mount the stroking tools of this invention at desired locations on a human body. The stroking tool stand comprises pliable legs and suction cups.

8 Claims, 18 Drawing Figures

FIG. 3
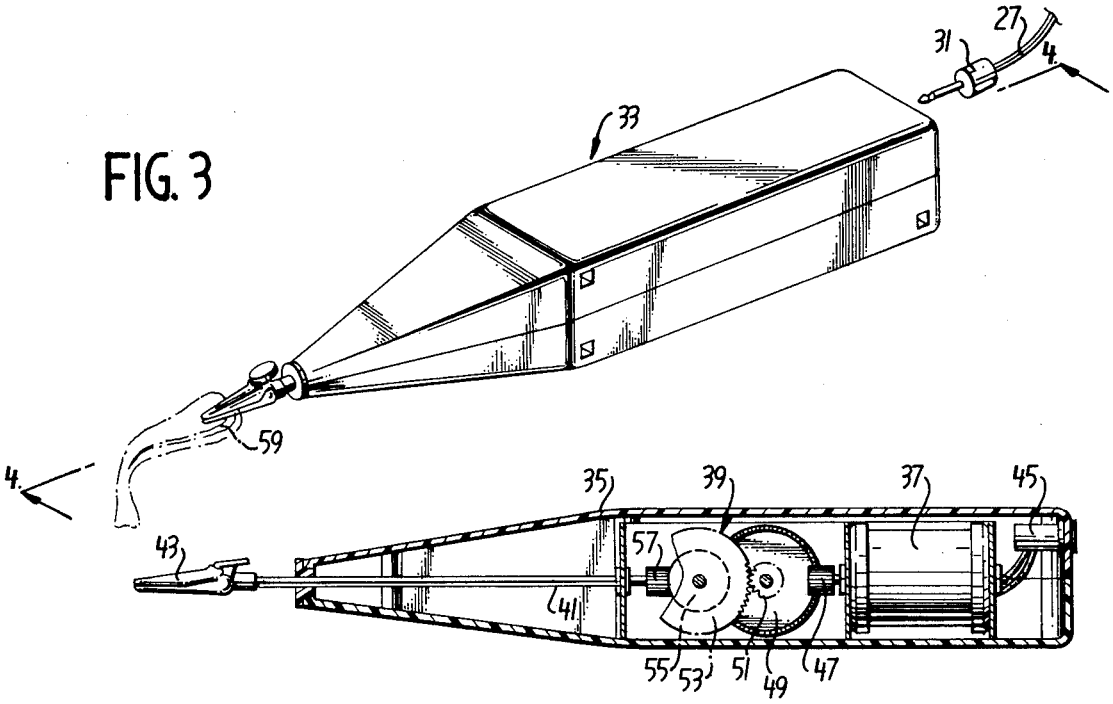
FIG. 4
FIG. 5
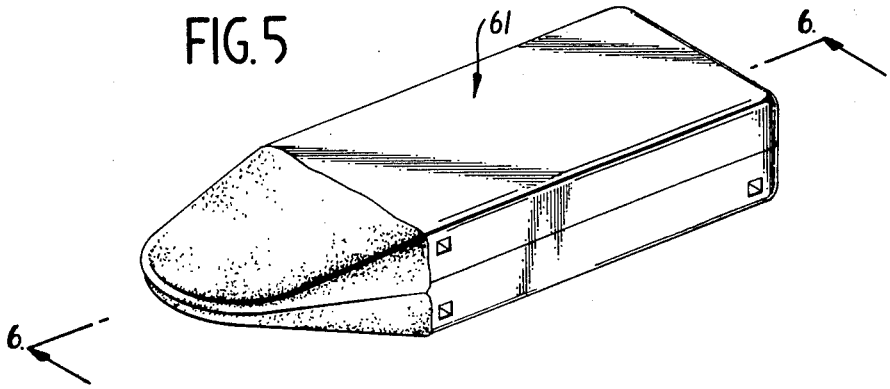
FIG. 6
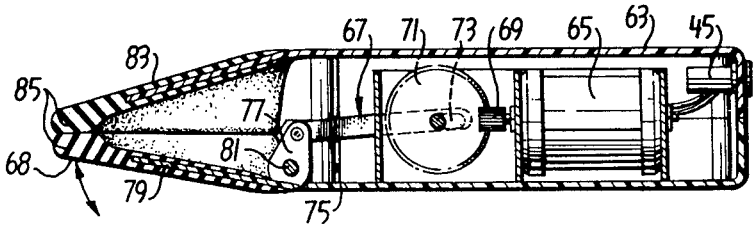

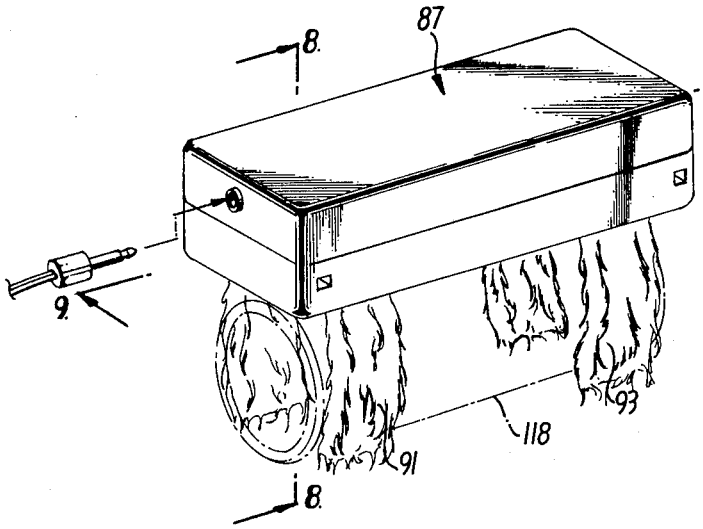
FIG. 7
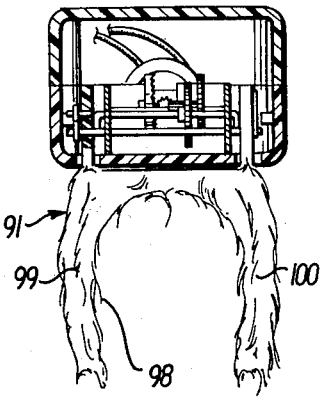
FIG. 8
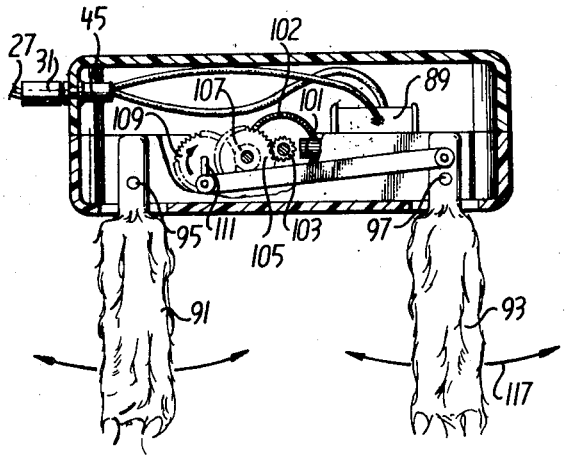
FIG. 9
FIG. 10
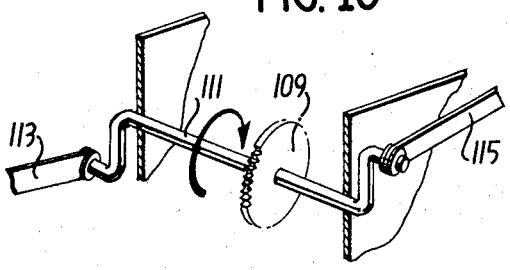
FIG. 11
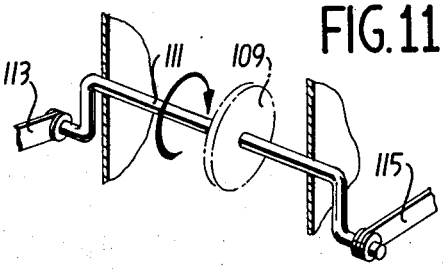

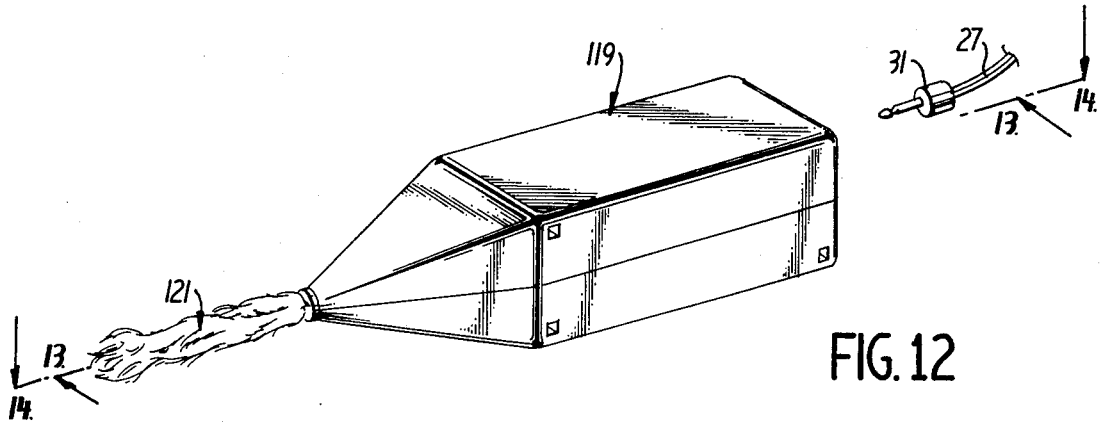
FIG. 12
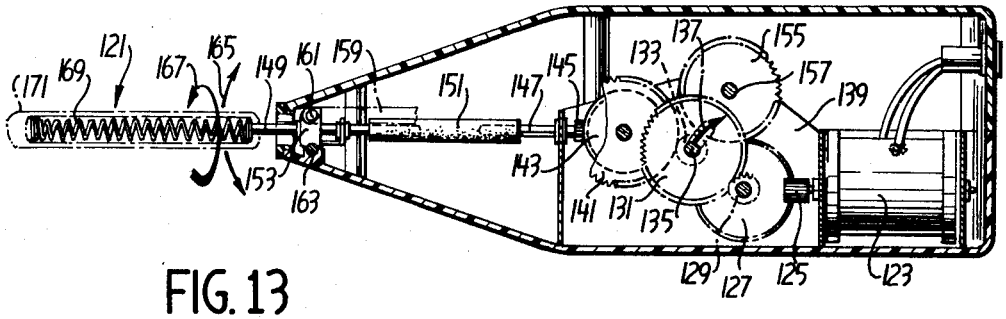
FIG. 13
FIG. 14
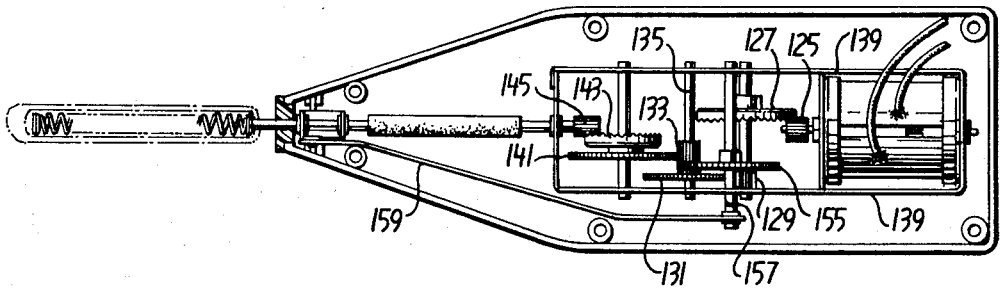

FIG. 17
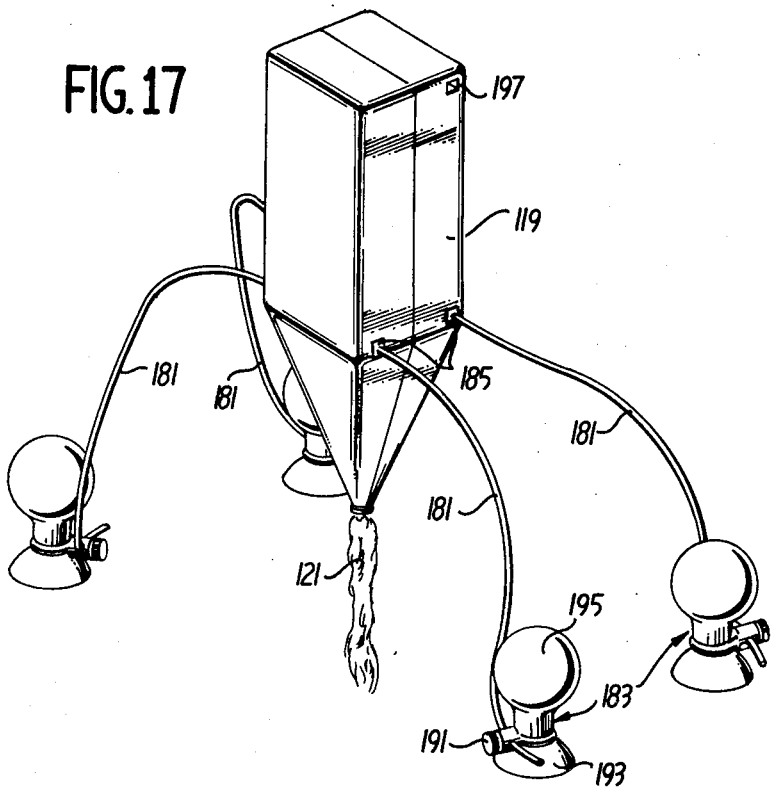
FIG. 16
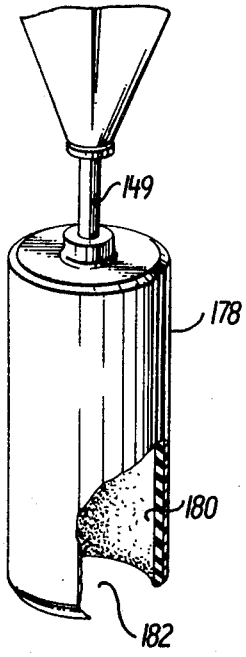
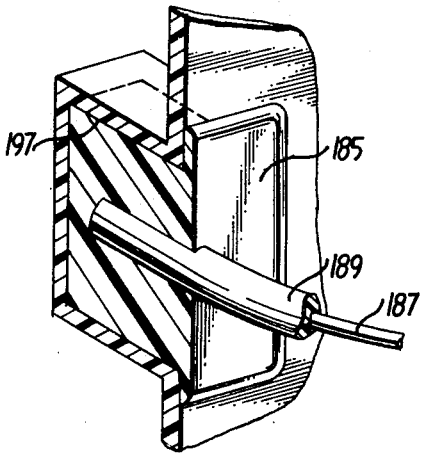
FIG. 18
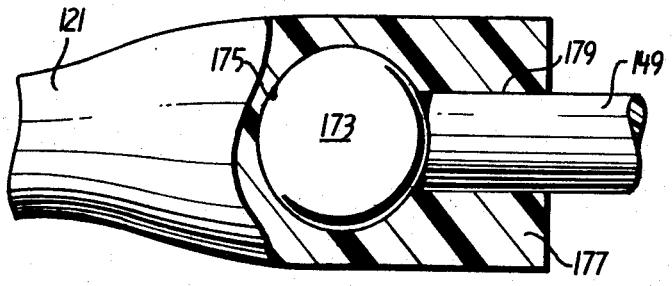
FIG. 15

MASSAGING APPARATUS

This is a division of application Ser. No. 348,128, filed Apr. 5, 1973, and now U.S. Pat. No. 3,874,373.

BACKGROUND OF THE INVENTION

This invention relates generally to the art of body massaging devices and more particularly to sexually stimulating stroking machines to be used on various erotically sensitive regions of the body.

Heretofore many persons, for various reasons, have failed to achieve sexual fulfillment in normal, heterogeneous sexual activities. Such failures can, and quite often do, result in both health and social problems. In this regard, some medical experts feel that many causes of incompatability between married couples can be traced directly to apparent sexual deficiencies which are psychological in nature rather than physiological. Also, some medical authorities feel that apparent sexual deficiences can, in turn, cause mental anxieties which could "snow ball" into severe mental problems. Thus, some people become "locked" in "mental-anxiety" situations which continually reenforce themselves and make it difficult for these people to mentally participate in normal sexual activities. Some such apparent sexual deficiencies have been described as female frigidity and male impotency, for example.

In recent years doctors and other experts have employed various forms of genital stimulation to treat the sexual deficiencies described above. Such treatments are sometimes used, for example, to "train" the sex organs of so called frigid females to function properly, or to verify to the satisfaction of both males and females that their sex organs are physiologically sound. Some experts have turned to the use of vibrators and other mechanical massaging devices for performing such manipulations.

Thus, it is an object of this invention to provide a massaging apparatus which can be used to treat various forms of sexual deficiencies.

It is another object of this invention to provide such massaging apparatus which are relatively uncomplicated in structure and relatively inexpensive to construct, but yet are effective.

SUMMARY OF THE INVENTION

According to principles of this invention, a combination massager apparatus comprises a power pack which is remote from one of a plurality of stroking devices. The power pack is used for controlling the motion of the stroking device as well as for providing energy to energize the stroking devices.

The various stroking devices which can be coupled to the power pack provide various types of stroking motions. All of the stroking devices have attachable or fixed stroking tools which stroke at adjustable speeds.

A rotating-type stroking device comprises a shaft-mounted clamp which can be clamped to an elongated limp, flexible material to rotate it. Thus, the flexible material is used as a stroking tool.

A "clasping"-type stroking device comprises an elongated mouth have a movable jaw which moves toward and away from a stationary jaw portion of a stroking device housing. Both the movable jaw and the stationary jaw portions are covered with a soft material.

A gripping-type stroking tool comprises a gripping member, having two gripping arms. In the preferred embodiment there are two gripping members which are pivoted so that they have back-and-forth stroking motions. In one mode of operation the stroking motions are in phase and in another mode of operation they are 180° out of phase.

A rotating/swinging stroking device includes a system for attaching different elongated stroking tools of this invention for different types of massages. The stroking device rotates the stroking tool in one mode of operation and pivots back-and-forth, in a swinging/flicking motion in another mode of operation. One such elongated tool includes a cylindrical-helical-spring core, another a clamp, and another an elongated cylinder.

Also according to the principles of this invention, a stand can be used to position the stroking tools of the various stroking devices at desired locations.

BRIEF DESCRIPTION OF THE DRAWINGS

The foregoing and other objects, features and advantages of the invention will be apparent from the following more particular description of preferred embodiments of the invention, as illustrated in the accompanying drawings in which reference characters refer to the same parts throughout the different views. The drawings are not necessarily to scale, emphasis instead being placed upon illustrating the principles of the invention in a clear manner.

FIG. 3 is an isometric view of a rotating-type stroking device employing principles of this invention;

FIG. 4 is a sectional view taken on line 4—4 in FIG. 3;

FIG. 5 is an isometric view of a clasping-type stroking device employing principles of this invention;

FIG. 6 is a sectional view taken on line 6—6 of FIG. 5;

FIG. 7 is a gripping-type stroking device employing principles of this invention;

FIG. 8 is a sectional view taken on line 8—8 of FIG. 7;

FIG. 9 is a sectional view taken on line 9—9 of FIG. 7;

FIG. 10 is an isometric view of a first configuration of a crank employed in the gripping stroking device of FIG. 7;

FIG. 11 is an isometric view of a crank similar to the FIG. 10 crank, but in a second configuration;

FIG. 12 is an isometric view of a rotating/swinging-type stroking device employing principles of this invention;

FIG. 13 is a sectional view taken on line 13—13 of FIG. 12;

FIG. 14 is a sectional view taken on line 14—14 of FIG. 12;

FIG. 15 is a sectional view of a stroking tool attaching mechanism which can be used with the stroking device of FIG. 12;

FIG. 16 is an isometric view of a rotating/swinging stroking device of FIG. 12 with a flexible, hollow cylinder tool attachment thereon;

FIG. 17 is an isometric view of the rotating/swinging stroking device of FIG. 12 when combined with a stand employing the principles of this invention; and FIG. 18 is an enlarged sectional view showing the coupling between stand legs and the stroking device housing depicted in FIG. 16.

DESCRIPTION OF PREFERRED EMBODIMENTS

Figure 1:
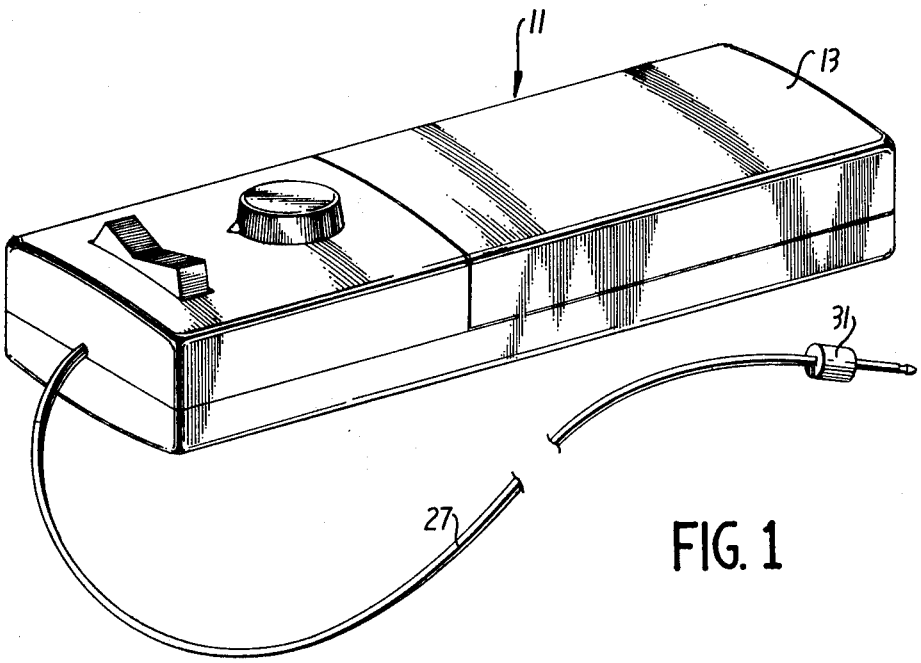
FIG. 1 is an isometric view of a power pack which is used in this invention.
Figure 2:
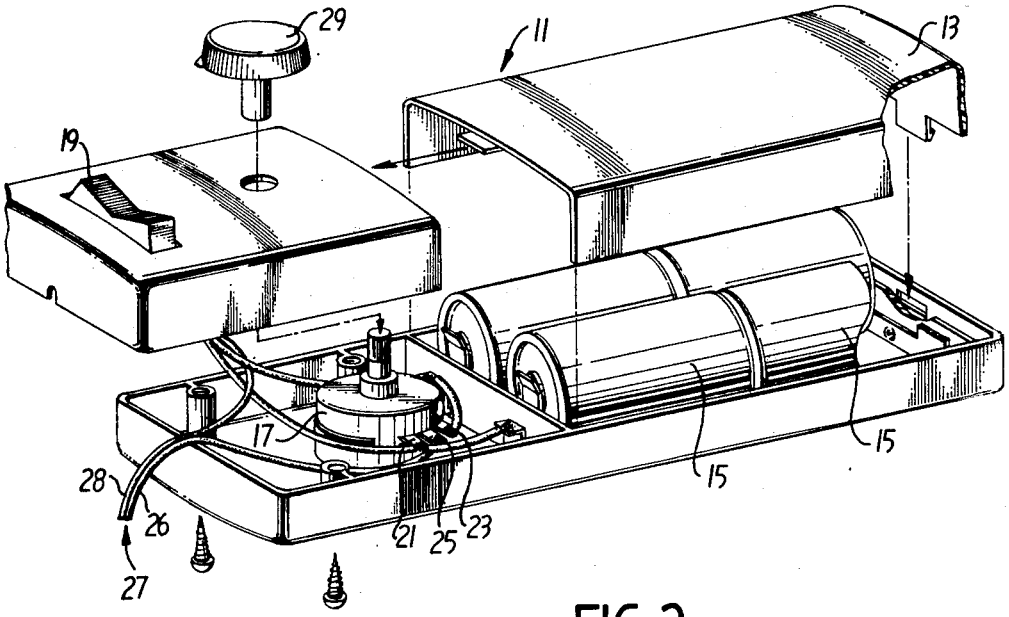
FIG. 2 is an exploded view of the power pack of FIG. 1.

Referring now to FIGS. 1 and 2 there is shown a power pack 11 comprising a housing 13, batteries 15, a rheostat 17, a three-way switch 19, and various other electrical terminals and wires.

Basically, the batteries 15 are connected in series between a positive rheostat terminal 21 and a negative rheostat terminal 23. A brush terminal 25 is coupled to a first lead 26 of an energizing line 27. Each of the positive and negative terminals 21 and 23 are connected to the three-way switch 19, and the three-way switch 19 is connected to a second lead 28 of the energizing line 27.

A rheostat knob 29 is used to adjust the potential of the brush terminal 25 relative to the positive and negative terminals 21 and 23.

The power pack 11 could be mounted directly on a stroking device without the use of a cord or jack as depicted in FIG. 1.

In operation of the power pack of FIGS. 1 and 2, when neither side of the three-way switch 19 is pressed down, as is the case in FIG. 2, neither the positive rheostat terminal 21 nor the negative rheostat terminal 23 is connected to the second lead 28 of the energizing line 27. However, when one side of the three-way switch 19 is pressed down the positive rheostat terminal 21 is connected to the second lead 28 and when the other side of the three-way switch 19 is pressed down the negative rheostat terminal 23 is connected to the second lead 28. Thus, the polarity of the energizing signal appearing on the energizing line 27 depends on which side of the three-way switch 19 is depressed, and the magnitude of this signal depends upon the position of the rheostat knob 29. This signal is used to control the operations of stroking devices with which a male plug 31 (FIG. 1) is coupled.

Turning now to FIGS. 3 and 4, wherein the energizing line 27 and the male plug 31 are depicted about to be coupled to a rotating-type stroking device 33, the rotating-type stroking device 33 comprises an outer housing 35, a variable speed motor 37, a gear linkage system 39, a drive shaft 41, and a universal stroking-tool attachment 43.

A jack 45 receives the male plug 31 and is electrically coupled to the variable speed motor 37. The direction in which the variable speed motor 37 rotates depends upon the polarity of the signal with which it is energized. The variable speed motor 37 rotates the drive shaft 41 through the gear linkage system 39 by directly driving a pinion gear 47 which meshes with a crown gear 49. The crown gear 49 is affixed to a spur gear 51 which meshes with a larger spur gear 53. A crown gear 55 is affixed to the spur gear 53 and meshes with a pinion gear 57. The pinion gear 57 is affixed to, and drives, the drive shaft 41.

A universal stroking-tool attachment 43 comprises a soft, rubberized clamp which can attach an elongated limp tongue-like stroking member to the drive shaft 41. For example, in one embodiment of this invention the universal stroking-tool attachment 43 is clamped to an elongated, limp tool 59 which is constructed of soft rubber. The elongated limp tool 59 is limp to the extent that its own weight causes it to bend and hang limply as shown in FIG. 3. Thus, when it is pushed against a human body it applies a very slight pressure only against the body. It should be understood, however, that other light weight materials or objects could be similarly clamped to the drive shaft 41.

In operation of the stroking device of FIG. 3, the elongated limp tongue-like tool 59 is gripped by the universal stroking-tool attachment 43 and this material is brought into contact with an erogenous zone of a human body. The rotating-type stroking device is held so that its longitudinal axis is approximately normal with the human body and the elongated limp tongue-like tool 59 is therefore, bent against the body, with a portion thereof lying on the erogenous zone. Either side of the three-way switch 19 (FIG. 2) is pressed down thereby energizing the variable speed motor 37 which causes the drive shaft 41 to rotate via the gear linkage system 39. The drive shaft 41 rotates the universal stroking-tool mounting member 43 which, in turn, rotates the elongated limp tongue-like tool 59. The elongated limp tongue-like tool 59 moves in circular motions on the body and the portion thereof which is lying on the body moves in an irregular manner as it rotates, thereby providing pleasurable sensations to the stroked erogenous zone. The speed at which the variable speed motor 37 rotates the elongated limp tongue-like tool 59 can be adjusted by rotating the rheostat knob 29, and the direction in which it rotates can be changed by pressing opposite sides of the three-way switch 19 thereby changing the polarity of the signal energizing the variable speed motor 37.

FIG. 5 depicts a clasping-type stroking device 61 which again comprises an outer housing 63, a variable speed motor 65, a linkage system 67 and a movable jaw 68.

The linkage system 67 includes a pinion gear 69 which is driven directly by the variable speed motor 65. The pinion gear 69 meshes with a crown gear 71 and the crown gear 71 is affixed to a crank 73. The crank 73 is rotatably attached to a rod 75 and the rod 75 is pivotally attached to a lever 77. The lever 77 is fixedly attached to a rigid skeleton portion 79 of the movable jaw 68.

The movable jaw 68 and the lever 77 are pivotally attached to the housing 63 at a pivot pin 81. The movable jaw 68 and a jaw portion 83 of the housing 63 together form a "mouth" and each of these members have soft rubber or fur coverings 85 thereon.

In operation, the soft rubber or fur coverings 85 of the movable jaw 68 and the jaw portion 83 are placed against an erogenous zone to be stroked and gripped. Either side of the three-way switch 19 (FIG. 2) is depressed thereby energizing the variable speed motor 65. The variable speed motor 65 causes the crown gear 71 to rotate the crank 73 which, in turn, causes the rod 75 to reciprocate longitudinally. This, in turn, causes the lever 77 and the movable jaw 68 to pivot in an oscillatory manner about the pivot pin 81. Thus, the soft rubber coverings 85 of the movable jaw 68 and the jaw portion 83 move together and apart to thereby provide a gentle grasping or gripping of the stroked erogenous zone. The speed of this stroking can be adjusted by turning the rheostat knob 29 (FIG. 2).

With regard to FIGS. 7–11, a gripping-type stroking device 87 is depicted wherein a variable speed motor 89 causes first and second gripping members 91 and 93 to pivot back-and-forth on respective pivot pins 95 and 97. Each of the first and second gripping members 91 and 93 comprises gripping arms 99 and 100 which are covered with a soft yieldable material 98, such as rubber or fur, for example. It should be understood that the opposite gripping arms 99 and 100 could be semicircular in shape and could be joined at the ends thereof so as to form a circle.

The variable speed motor 89 rotates a pinion gear 101. The pinion gear 101 meshes with a crown gear 102 and the crown gear 102 is affixed to a spur gear 103. The spur gear 103 drives a spur gear 105 and an affixed spur gear 107 drives another spur gear 109. A crank 111 is affixed to the spur gear 109 and rotates therewith. A first rod 113 (FIGS. 10 and 11) is pivotally attached to one end of the crank 111 and a second rod 115 is pivotally attached to the other end of the crank 111.

Thus, as the variable speed motor 89 rotates the crank 111 through the various gears, it reciprocates the first and second rods 113 and 115. The first rod 113 is attached to the first gripping member 91 on the opposite side of the pivot pin 95 from the gripping arms 99 and 100 and the second rod 115 is attached to the second gripping member 93 on the opposite side of the pivot pin 97 from the gripping arm 99 and 100. Thus, as the first and second rods 113 and 115 reciprocate longitudinally they cause the first and second gripping members 91 and 93 to pivot back and forth as indicated by arrows 117 in FIG. 9.

In this manner the gripping members 91 and 93 can be caused to pivotally oscillate either in phase or 180° out of phase, by using differently shaped cranks 111 as respectively depicted in FIGS. 10 and 11.

In operation, the gripping arms 98 of the first and second gripping members 91 and 93 are placed on opposite sides of a male genital organ and one side of the three-way switch 19 is depressed. The variable speed motor 89 is energized to cause the first and second gripping members 91 and 93 to oscillate back and forth and thereby stroke the male genital organ. Again the speed at which the first and second gripping members 91 and 93 reciprocate back-and-forth can be gradually adjusted.

It should be understood that it would also be possible to construct an embodiment of this invention wherein the gripping members 91 and 93 can be readily caused to pivotally oscillate either in phase or 180° out of phase by merely depressing opposite sides of the three-way switch 19 (FIG. 2), although such an embodiment is not depicted herein.

Further, this gripping device can be combined with a tubularly shaped male-genital-organ holder 118, depicted in FIG. 7.

It can be readily appreciated that this device provides a relatively uncomplicated but effective device for aiding in erecting a male genital organ.

Turning now to a rotating/swinging stroking device 110 depicted in FIGS. 12–16, this device includes a stroking tool 121 which a variable speed motor 123 causes to either rotate and pivot back and forth, depending on which side of the three-way switch 19 (FIG. 2) is depressed.

In this device the variable speed motor 123 drives a pinion gear 125 directly and this gear, in turn, drives a crown gear 127 along with an affixed spur gear 129. The spur gear 129 drives a large spur gear 131 as well as an affixed, small spur gear 133. The large spur gear 131 and the small spur gear 133 are affixed to a shaft 135 which has freedom to move in slots 137 of mounting members 139 (FIG. 14) located at each end of the shaft 135.

When the shaft 135 is at the lower ends (as seen in FIG. 13) of the slots 137 the small attached spur gear 133 meshes with, and drives, a spur gear 141 as well as an attached crown gear 143. The crown gear 143 drives a pinion gear 145 which is affixed to a first drive-shaft section 147. The first drive shaft section 147 is interconnected with a second drive shaft section 149 by means of a resilient sleeve 151. The second drive shaft section 149 is journaled in a lever-mounted bearing 153 which allows the second drive shaft section 149 to pivot.

Returning to the large spur gear 131 and the small spur gear 133, when the shaft 135 is at the top (as seen in FIG. 13) of the slots 137, the small spur gear 133 meshes with a spur gear 155. The spur gear 155 is affixed to a crank 157 which can be seen in FIG. 14. The crank 157 is pivotally attached to a rod 159 and this rod is pivotally attached to the lever-mounted bearing 153 at a pivot pin 161. When the rod 159 reciprocates longitudinally it causes the lever bearing 153 to pivot about a pivot pin 163 and thereby causes the second drive shaft section 149 to oscillate back-and-forth as indicated by arrows 165.

In operation, the stroking tool 121 is placed against an erogenous zone of the body and one side of the three-way switch 19 is depressed. Depending on which side of the three-way switch 19 is depressed, the crown gear 127, and the spur gear 129 will be driven by the variable speed motor 123 either in a clockwise direction or counterclockwise direction as seen in FIG. 13. If these gears are driven in a counterclockwise direction the shaft 135 is urged downwardly in the slots 137 so that the small attached spur gear 133 meshes with the spur gear 141 and, as described above, causes the second drive section 149 and the attached stroking tool 121 to rotate as indicated by an arrow 167.

However, when the other side of the switch 19 is depressed so that the crown gear 127 is driven in a clockwise direction, the shaft 135 is urged upwardly in the slots 137 so that the small attached spur gear 133 now meshes with the spur gear 135. The spur gear 155 rotates the crank 157 which causes the rod 159 to reciprocate. This reciprocation causes the lever bearing 163 to pivot back and forth on the pivot pin 163 thereby imparting a back-and-forth oscillating motion to the stroking tool 121 as indicated by the arrows 165.

The stroking tool 121 comprises a cylindrical, helical spring 169 which is mounted on the second drive shaft section 149 at one end thereof, and has a soft outer covering 171. In the illustrated embodiment the soft outer covering 171 is made of fur but in another embodiment it is made of a soft rubber. However, the soft outer covering 171 is flexible such that the attitude and configuration maintained by the stroking tool 121 is primarily determined by the spring 169, and the outer covering 171, more or less, merely provides a soft surface for contacting a body. Thus, the stroking tool 121 has finger-like qualities as the stroking tool 121 swings back and forth or rotates, as indicated by arrows 165 or 167. If it is swinging, the elongated spring 169 causes a flicking-type stroke to be applied by the stroking tool 121 to an erogenous zone being stroked.

An operator can alternately switch between a rotating motion of the stroking tool 121 and a swinging motion of the tool to impart highly sensual stimulation to an erogenous zone.

FIG. 15 depicts a possible connecting system which could be used to attach a stroking tool 121 to the second drive shaft section 149. The connecting system comprises a ball 173 affixed to the end of the second drive shaft section 149 and a cavity 175 formed in a resilient sleeve 177 of the stroking tool 121. A restricted portion 179 of the cavity 175 stretches to allow the ball 173 to enter a larger section of the cavity and thereafter closes to hold the stroking tool 121 on the second drive shaft section 149.

It should be understood that numerous attachments could be used with the rotating/swinging stroking device depicted in FIGS. 12–14 by means of a connecting system as is depicted in FIG. 15. For example, a clamp, such as the clamp 43 of FIGS. 3 and 4 could be attached to the second drive shaft section 149.

Further, another stroking tool is depicted in FIG. 16 which comprises an elongated hollow cylinder 178 with a soft rubber interior 180. The stroking tool is attached to the second drive shaft section 149, by a connecting system as is depicted in FIG. 15, for example, so as to stroke in either a swinging or a stroking motion. A male genital organ is then placed inside an open end 182 and is massaged by gentle movements. An operator can alternately switch between a rotating motion of the elongated hollow cylinder 178 and a pendulum-swinging motion to impart highly sensual stimulation. The speed at which the variable speed motor 37 rotates or swings can be adjusted by the rheostat knob 29.

FIG. 17 depicts a stand assembly which is used to position the stroking tool 121 of the rotating/flicking stroking device 119 so as to stroke a desired erogenous zone of the body. In this regard, the stand assembly comprises pliable wire legs 181, suction cup assemblies 183 and anchoring devices 185.

The pliable wire legs 181 comprise pliable wire skeletons 187 having resilient coverings 189 thereon.

The suction cup assemblies 183 are mounted on first ends of the wire legs 181 by means of locking screws 191. Each of the suction cup assemblies 183 comprises a suction cup 193 and a resilient bulb 195. The resilient bulb communicates with the inside of the suction cup 193; thus, when the resilient bulb 195 is depressed and released a suction is created within the suction cup 193.

The anchoring devices 185 are attached to the opposite ends of the pliable wire legs 181 and these are inserted in mounting cavities 197 in the housing of the rotating/flicking stroking device 119. The anchoring devices 185 are resilient so that after they are pressed into the mounting cavities 197 they are retained there by their natural tendencies to expand.

It can be seen in FIG. 16 that mounting cavities 197 are positioned at various locations on the housing of the rotating/flicking stroking device 119 so that the pliable wire legs 181 can be anchored to the housing at various locations; thereby aiding in positioning the stroking tool 121 at desired locations.

In operation, to position the stroking tool 121, the suction cup assemblies 183 are caused to adhere to a human body at locations around the location of an erogenous zone to be stroked. Such adherence is accomplished by moistening the outer edges of the suction cups 193, depressing the resilient bulbs 195 and pressing the suction cups 193 against areas to be adhered to. The pliable wire legs 181 are then easily bent so as to position the stroking tool 121 at the erogenous zone to be stroked.

It will be understood by those skilled in the art that the massaging apparatus described herein allows a user to stroke a remote area but yet control the speed and type of stroking. Such remote control allows a user to more closely simulate heterogenous sex foreplay than with a hand held massager.

Further, the stroking device of this invention provides relatively uncomplicated mechanisms for use as effective, and highly stimulating, genital massagers.

It will be understood by those skilled in the art that various changes in form and detail may be made in this invention without departing from the spirit and scope of the invention. For example, the stroking devices of this invention could be energized by AC house current rather than by a DC battery pack as described herein. Further, a power pack could be mounted directly on or in a stroking device housing rather than being remote therefrom as it is in the depicted embodiments.

The embodiments of the invention in which an exclusive property or privilege are claimed are defined as follows:

1. A stroking device for stroking erogenous zones of a human body, said stroking device comprising:

a housing;

an elongated stroking tool positioned outside of said housing for making contact with said erogenous zones of said human body;

an electric motor for moving said elongated stroking tool mounted in said housing;

mechanical linkage interconnecting said electric motor and said elongated stroking tool;

an electric power source means coupled to said electric motor for furnishing electrical energy to said electric motor;

control means which can be used to adjust the mechanical linkage to a first configuration wherewith said elongated tool is caused to rotate and to a second configuration wherewith said stroking tool is caused to pivot laterally back-and-forth;

whereby said elongated stroking tool may be brought into contact with said erogenous zones of said human body and caused to stroke said zones in both circular motions and lateral back-and-forth motions.

2. A stroking device as claimed in claim 1 wherein said mechanical linkage is such that when said motor runs in a first direction said elongated stroking tool is caused to rotate and when said motor runs in a second direction said elongated stroking tool is caused to pivot laterally back and forth, and wherein said control means includes a means for controlling the polarity of an electrical energy signal supplied to said electrical motor to thereby control the direction in which said electric motor runs.

3. A stroking device as claimed in claim 1 wherein said elongated stroking tool includes a resilient core of appropriate resiliency to allow said stroking tool to easily bend perpendicularly to an axis thereof when slightly loaded but of sufficient resiliency to cause said elongated stroking tool to return to an elongated configuration when unloaded.

4. A stroking device as claimed in claim 1 wherein said elongated stroking tool has a hollow cylindrical shape with a soft interior for receiving a male genital organ.

5. A stroking device as claimed in claim 1 wherein said elongated stroking tool comprises a clamp which can be attached to flexible materials.

6. A body massaging apparatus comprising the combination of:

a stroking device for stroking erogenous zones of the human body, said stroking device including:

a stroking-device housing;

a stroking tool extending from said stroking-device housing for making contact with said erogenous zones of said human body;

an electric motor mounted in said stroking-device housing for moving said stroking tool; and mechanical linkage connecting said electric motor and said stroking tool;

a power-pack means electrically coupled to said stroking-device for controlling the motion of said stroking tool, said power-pack means comprising an electric energy supply source means for providing electrical energy to energize said electric motor;

a stand attached to said stroking-device for supporting said stroking-device housing on said human body and for positioning said stroking tool so as to contact desired erogenous zones of said human body.

7. A body massaging apparatus as claimed in claim 6 wherein said stand comprises:

elongated pliable legs constructed of pliable wire, said legs being attachable to said stroking-device housing; and suction cups mounted on said legs for attaching said legs to said human body.

8. A body massaging apparatus as claimed in claim 7 wherein each of said suction cups includes a suction bulb which communicates with a suction portion of said suction cup.

* * * * *